United States Patent [19]

Miles

[11] 4,355,526

[45] Oct. 26, 1982

[54] METHOD AND APPARATUS FOR UNCOILING AND STRAIGHTENING MATERIAL FOR PROCESSING THEREOF

[75] Inventor: John H. Miles, Ravenna, Ohio

[73] Assignee: Wean United, Inc., Pittsburgh, Pa.

[21] Appl. No.: 133,054

[22] Filed: Mar. 24, 1980

[51] Int. Cl.[3] ..... B21F 1/02

[52] U.S. Cl. ..... 72/164; 72/183; 140/147; 242/78.8

[58] Field of Search ..... 140/147; 72/160, 164, 72/183; 242/78.8

[56] References Cited

U.S. PATENT DOCUMENTS

| | | | |
|---|---|---|---|
| 2,219,811 | 10/1940 | Friedman | 140/147 X |
| 3,443,607 | 5/1969 | Dittrich | 140/147 |
| 3,908,922 | 9/1975 | Gutherie et al. | 242/54 R |

FOREIGN PATENT DOCUMENTS

| | | | |
|---|---|---|---|
| 1020595 | 12/1957 | Fed. Rep. of Germany | 242/78.8 |

*Primary Examiner*—Gil Weidenfeld
*Assistant Examiner*—Fred A. Silverberg
*Attorney, Agent, or Firm*—Daniel Patch; Suzanne Kikel

[57] ABSTRACT

A method and apparatus for uncoiling material such as wire, from a coil supported about a horizontal axis by a drum, including separating a loop from the coil, and bending the leading end of the material upon its exit from a pinch roll unit so that it takes a path generally parallel to that of a predetermined passline, and straightening the material once the leading end passes through the straightener roll area. An end bender roll and two of the straightener rolls are mounted on a pivotal frame connected to a piston cylinder assembly which causes the frame to be rotated through an arc in a direction to either bring the end bender roll into an operative position while the two straightener rolls are in an inoperative position, or to bring the end bender roll into an inoperative position while the two straightener rolls assume a nested relationship with a fourth roll in an operative position.

22 Claims, 10 Drawing Figures

METHOD AND APPARATUS FOR UNCOILING AND STRAIGHTENING MATERIAL FOR PROCESSING THEREOF

BACKGROUND OF THE INVENTION

This invention relates to a method and means for initially uncoiling material in coiled form, and more particularly, when considered from an overall view, relates to a unique coordination and automation of components to (1) separate succeeding loops of material including the leading end from the coil prior to its entry between a set of pinch rolls, (2) unbend the leading end of material as it exits the pinch rolls so that it takes a path of travel generally parallel to a passline defined by the nip of the pinch rolls, and (3) after the leading end is positioned through the area of the straightening rolls, to advance the material through the straightener rolls, which are in an operative position.

When coiled material such as cold metal wire, rod or strip is to be uncoiled for subsequent processing it is frequently necessary to unbend and then support the leading end of the material immediately exiting a pinch roll unit so that it can be fed through straightener rolls. Attempts in the past to do this involved the mounting of a stationary shelf away from the passline between the pinch rolls and straightening rolls for supporting and guiding the leading and exiting the pinch roll unit, after which the end was manually positioned along the passline between the straightening rolls. Such a system involved considerable lost time and constant manual assistance which the attendant sacrificed in production and added man-hour expense. Another concern in uncoiling such material involves separating and guiding a loop from the coil as it is being paid off. Apparatuses for this purpose have heretofore been shown in U.S. Pat. Nos. 3,443,607 and 3,908,922. U.S. Pat. No. 3,443,607 illustrates a mechanism for guiding wire over a vertically adjustable roll prior to the wire's entry between the pinch rolls, and U.S. Pat. No. 3,908,922 illustrates additionally a rotatable separating disc mounted in proximity to a coil supporting drum. However, the guiding and separating mechanisms of the prior art do not prevent the coil supported on the drum from interferring with the other components of the uncoiler such as the pinch rolls, or from interferring with the loop being uncoiled which can result in the material becoming tangled or snarled. Both prior designs require extensive manual adjustment of the components of the uncoiler and operator supervision during its operation.

It is therefore an object of the present invention to provide a unique and novel uncoiling method and apparatus for automatically feeding the leading end and subsequent portions of material through the devices used for processing thereof, and for assuring a continuous operation of the uncoiler with relative ease and little or no operator assistance or supervision.

It is another object of the present invention to provide a method and apparatus for unbending, if necessary, a leading end of material and advancing it along a path of travel for automatic feeding into the straightening roll area and once the leading end is advanced a certain distance, to bring the straightener rolls into play to straighten the remaining material.

It is a further object of the present invention to provide a means having a dual function of unbending the leading end as it exits the pinch roll unit and then straightening subsequent material being paid off.

It is a still further object of the present invention to provide a means for guiding the material between the pinch roll unit and separating and protecting the loops being paid off and at the same time protecting the pinch roll unit from the supported coil.

More particularly it is an object of the present invention to provide in combination with an apparatus for uncoiling wire material or the like from a circular coil of wire and feeding it along the passline for further processing comprising means for uncoiling said coil in a manner that the leading end of the wire assumes its natural curvature, bending means located along said passline constructed and arranged for receiving said wire upon its exit from said uncoiling means, said bending means including a first means positionable in an inoperative position away from said passline for engaging a leading end of said wire and positionable in an operative position close to said passline for bending said leading end against its natural curvature to cause it to take a path generally parallel to said passline, and wire straightener means located along said passline constructed and arranged to receive said wire after said wire exits said bending means, said straightener means including first means locatable close to said passline for assuming a straightening position with a longitudinal surface of said wire and second means positionable in a feeding position away from said passline and in an operative position close to said passline for assuming a straightening position with an opposite longitudinal surface of said wire, and means for associating said first means of said bending means with said second means of said straightener means in a manner that when said first means of said bending means is positioned in its said inoperative position away from said passline, said second means of said straightener means is positioned in its said operative position close to said passline, and when said first means of said bending means is positioned in its said operative position close to said passline, said second means of said straightener means is positioned in its said feeding position away from said passline.

Another object is to provide an apparatus for uncoiling wire material or the like from a circular coil and preparing the wire for further processing comprising a support frame, coil supporting means carried by said support frame and having a rotatable drum over which a coil to be uncoiled is placed, a set of pinch rolls consisting of a lower and upper roll arranged to form a nip for engaging wire being uncoiled from said drum and feeding it along a predetermined passline for said wire, said lower pinch roll mounted coaxially with said drum, means for separating each succeeding loop of wire fed to said pinch rolls from said drum, said separating means having a loop of wire engaging and restraining portion constructed and arranged to assist said loop to be fed to said nip and a protective portion constructed and arranged to substantially separate and protect at least one of said pinch rolls from said coil supported by said drum.

A still further object of the present invention is to provide a method for uncoiling and preparing material such as wire for further processing from a circular coil of material supported generally horizontal by a rotatable drum cantileverly mounted to a frame, the steps comprising: (a) feeding the leading end of the wire through a set of pinch rolls defining a passline until the leading end engages the end bender roll positioned away from the passline, (b) causing the natural curvature of the material to be substantially removed and to take a path generally parallel to the passline by positioning the end bender roll toward the passline so that the wire contacts an anvil roll located on a side of the passline opposite to that of the end bender roll, (c) when step (b) is performed, causing at least two straightener rolls to be moved away from the passline so that the leading end is free to advance along said passline without interference with said straightening rolls while being supported by one of said rolls, (d) when the leading end has passed through the straightener rolls area, thereafter causing the two straightener rolls to be positioned toward the passline to support the material in said passline, and the end bender to be positioned away from the passline, and (e) while step (d) is in progress, or thereafter causing a third straightener roll located along the passline generally opposite the other two straightener rolls to be positioned toward the passline so that the straightener rolls contact the material in a nested relationship.

These and other objects of the present invention will be better understood and appreciated when the following description is read along with the accompanying drawings of which:

Figure 1:
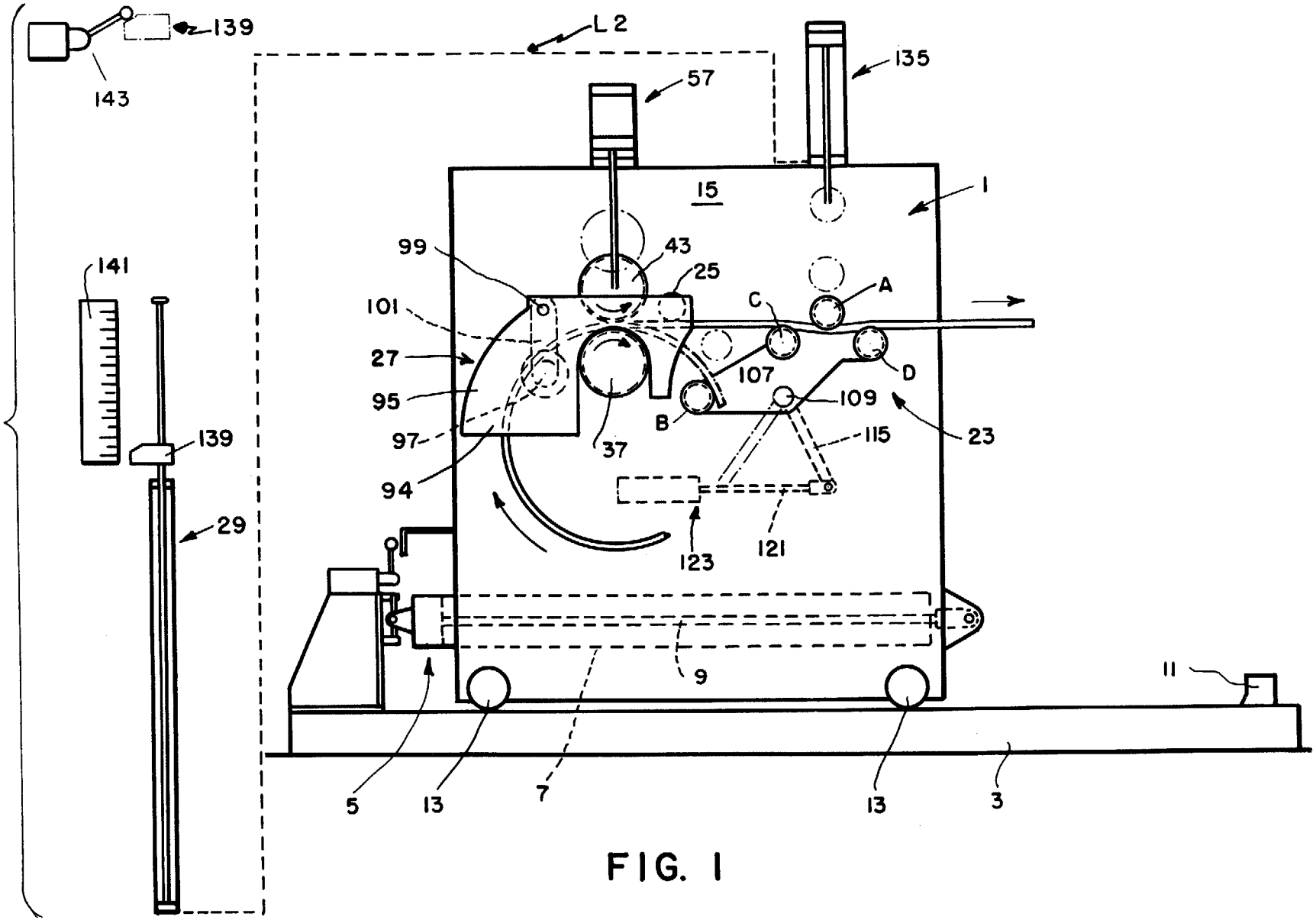
FIG. 1 is a schematic front elevational view of an uncoiling device for metal wire incorporating the features of the present invention.

Referring first to FIG. 1, there is illustrated a box-like frame 1, generally similar to that shown in the already mentioned U.S. Pat. Nos. 3,443,607 and 3,908,922. This frame 1 is mounted on a rectangular bed or track 3, and is provided with means for moving the frame horizontally. This motivating means consists of a piston cylinder assembly 5 having a cylinder 7 which is a permanent part of the frame 1 and a rod 9 having a stroke at least equal to the distance between the frame 1 and a stop 11, also mounted on the bed as shown in this FIG. 1. This moveable frame provides the versatility of both feeding and indexing wire in wire processing equipment downstream from the uncoiler and also preventing wire breakage by exhausting the pressure on the rod end of the cylinder to permit the frame to move freely along the rectangular bed 3 when the tension in the wire begins to increase to a level of concern. The initial movement actuates a switch to (a) exhaust air from the cylinder and (b) to shut down the line. The remaining movement allows for time to bring the line to a complete stop. Rollers 13 are mounted on all four corners of frame 1.

Figure 2:
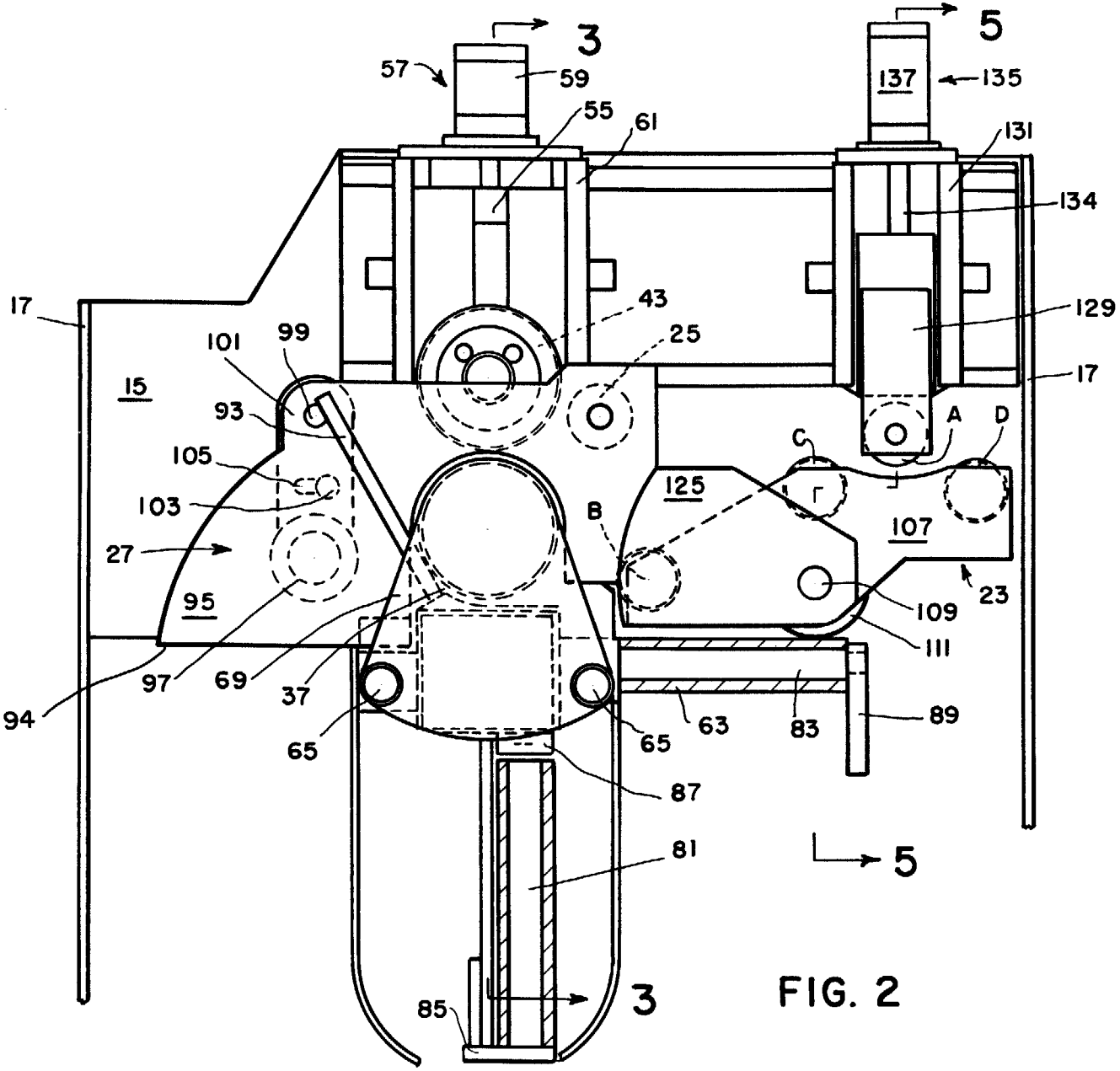
FIG. 2 is a front elevational view, partly in section, illustrating in more detail the uncoiling device of FIG. 1.
Figure 5:
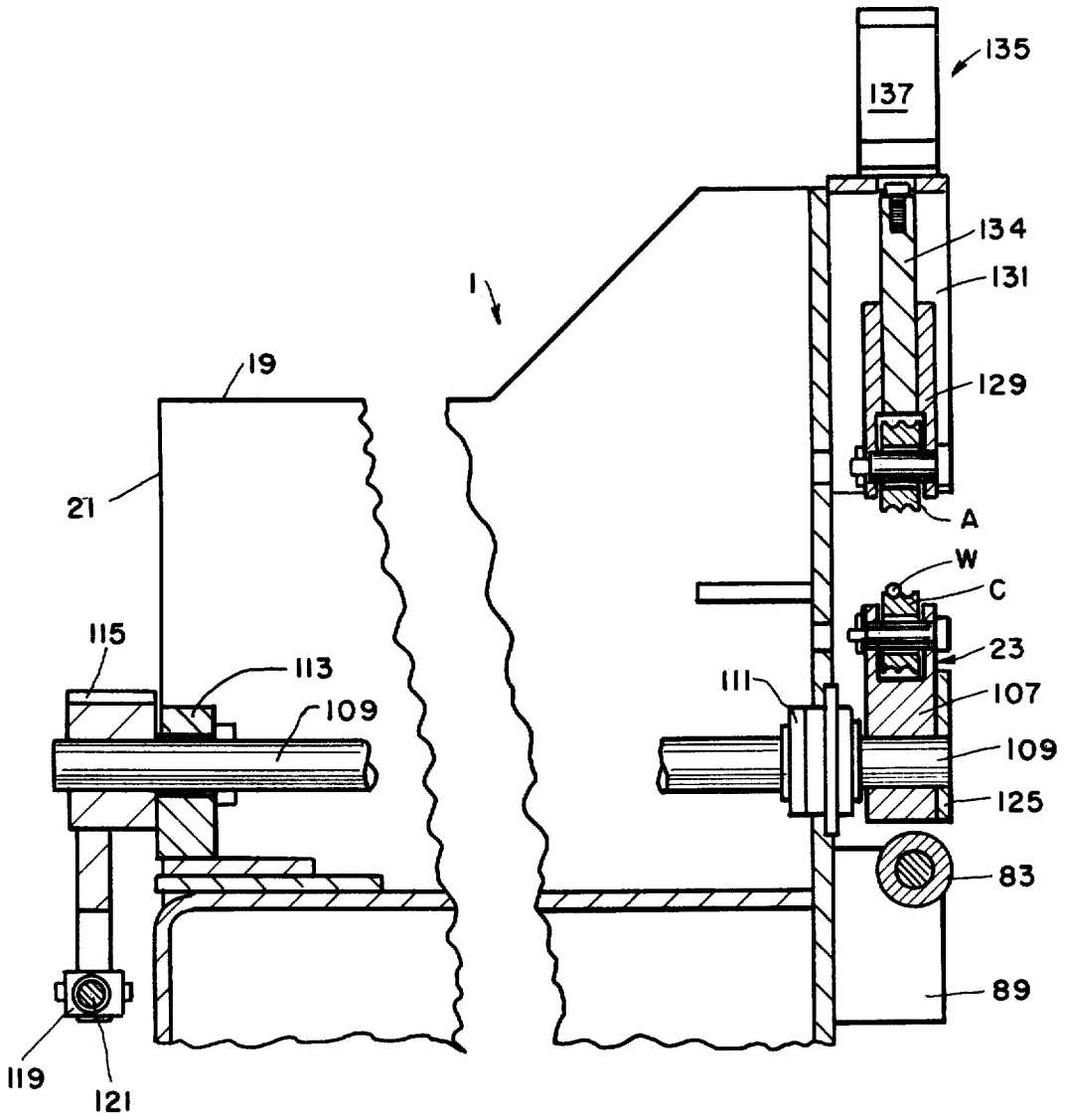
FIG. 5 is a sectional view taken along lines 5—5 of FIG. 2.

Referring to FIGS. 1, 2 and 5, frame 1 has front plate 15, spaced side plates 17, a top plate 19, and a back plate 21 (shown in FIG. 5). Some of the features of the present invention involves providing pivotal plate means 23 including lower straightener rolls C and D, anvil roll 25, separator means 27, and an upper straightening roll A controlled by a slave cylinder 29. Most of these components are located outwardly from front plate 15 of the frame and cooperate in a manner to uncoil, unbend, and straighten the wire being uncoiled with little or no interruption of the uncoiling process, which will become apparent shortly.

Figure 3:
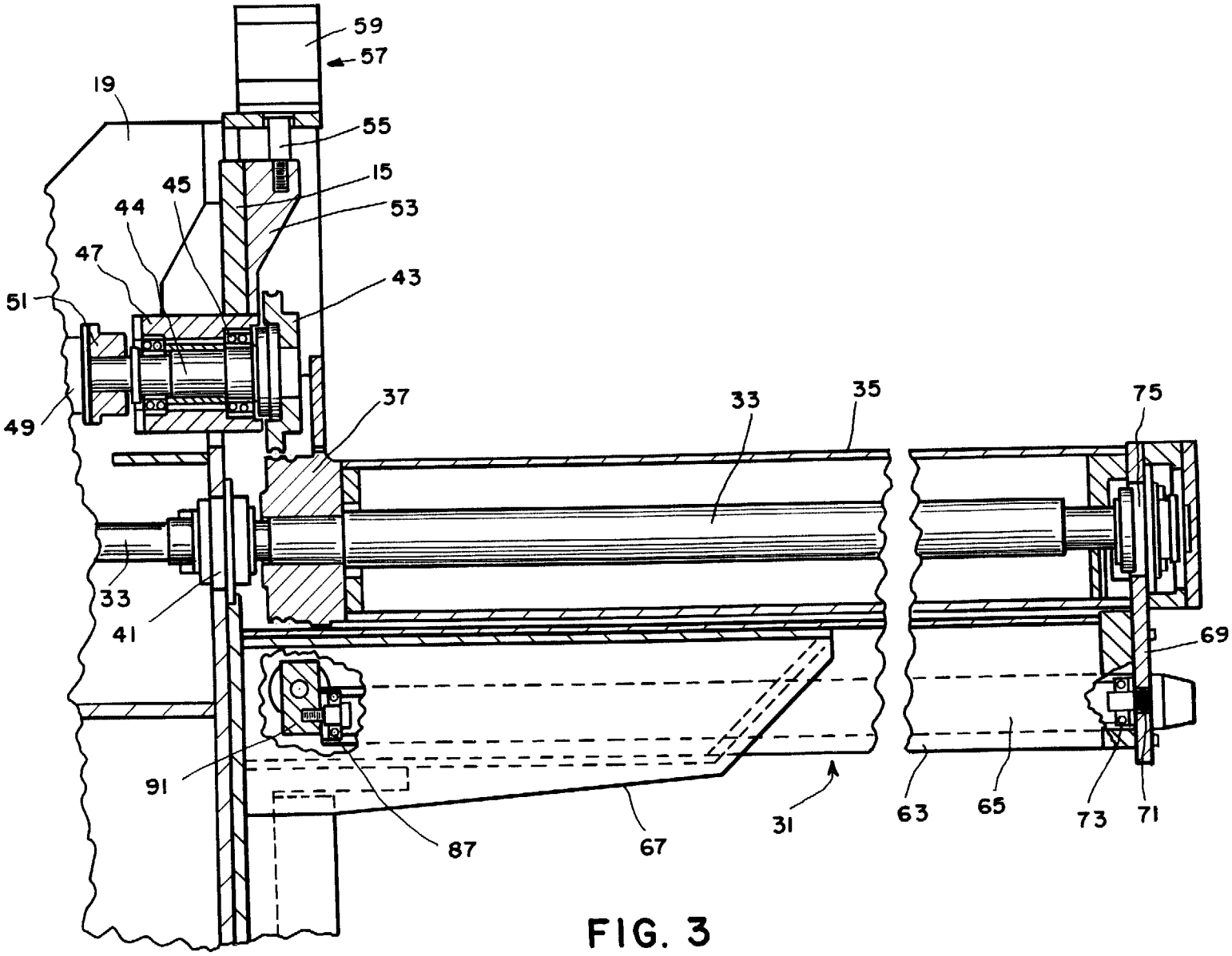
FIG. 3 is a partly broken away sectional view taken along lines 3—3 of FIG. 2.
Figure 4:
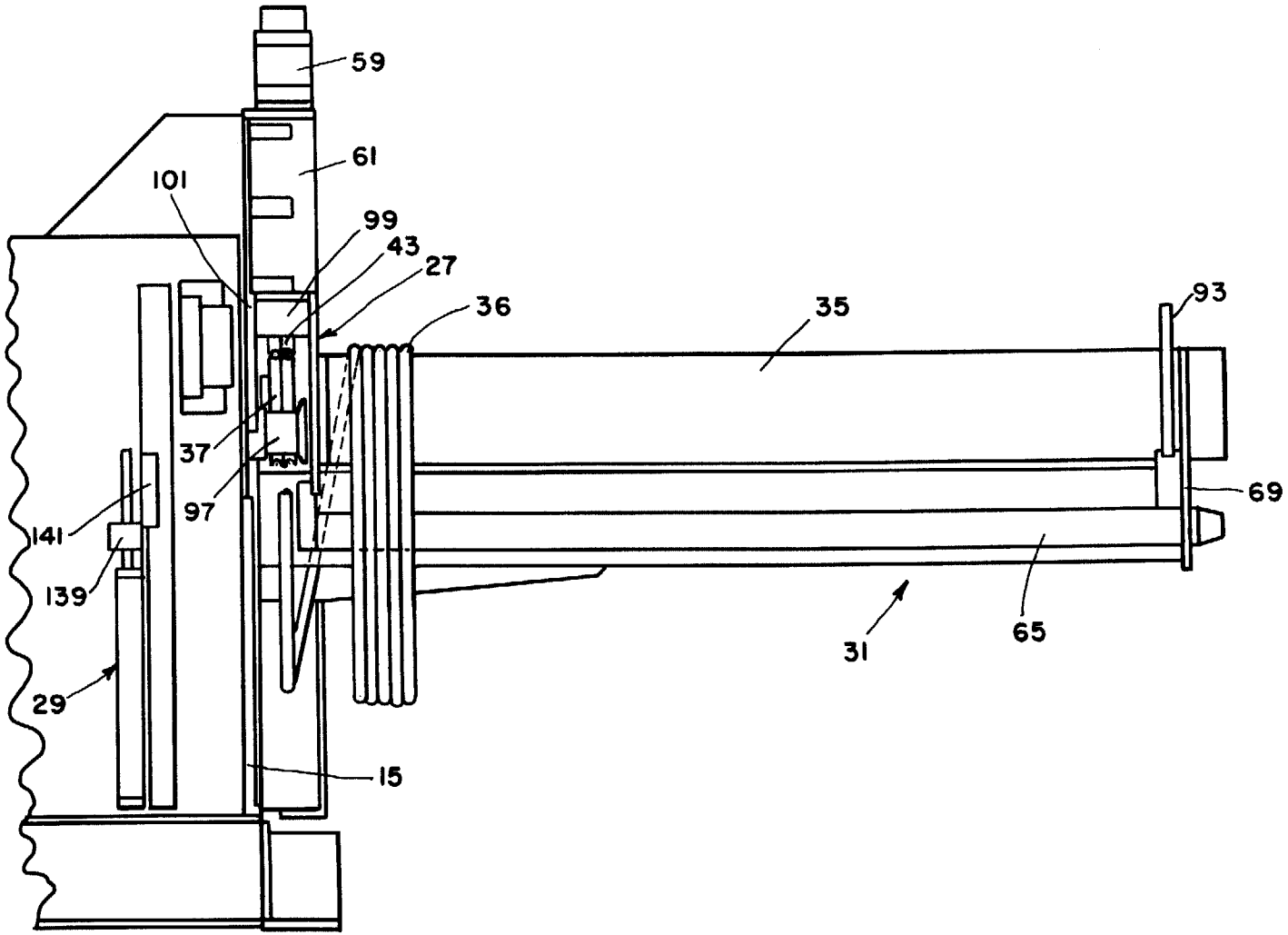
FIG. 4 is an outside elevational view of FIG. 3 to which has been added a portion of a coil to illustrate the manner in which the first convolution of the material is fed to the pinch roll unit.

In referring to FIGS. 3 and 4, also extending outwardly from front plate 15 and welded or otherwise mounted to the frame 1, is a boom assembly 31 which, along with frame 1, cantileverly supports a rotatably generally horizontal shaft 33 around which a drum 35 is mounted, which in turn supports a coil of wire 36 as shown in FIG. 4. Mounted coaxially on shaft 33 for rotation with and abutting the drum 35 is a lower pinch roll 37 keyed to shaft 33. Pinch roll 37 has two grooves for accommodating varying diameters of wire. Shaft 33 is coupled to a driven shaft not shown, and into plate 15 through bearing 41. Cooperating with the lower pinch roll 37 to form a nip or gap into which the wire passes is an upper interchangeable pinch roll 43 having a single groove and cantileverly mounted in frame 1 by a shaft 44 and a bearing assembly 45. At the other end of a sleeve 47, a driven shaft 49 is coupled to the shaft 44 by a sliding coupling or universal joint 51.

As shown in FIG. 3, the upper pinch roll 43 lines up with the inter most groove of the lower pinch roll 37. By the use of shims, this upper roll 43 can be initially installed in correct alignment with the corresponding groove directly below it. Likewise, when it becomes necessary to run material in the outer groove, another roll is either attached to the outer face of roll 43 or roll 43 is completely removed and another roll is put on in its place. Here again, this roll can be shimmed to correctly line up with the outer groove directly below it.

Shafts 33 and 44 are synchronously driven either forward or reverse in a conventional manner through suitable gearing by a motor (not shown) located within the frame 1. By using clutches (not shown) shafts 33 and 44 can be driven or free-wheel. Connected to sleeve 47 is an element 53 having an enlarged portion to which a rod 55 of a fluid piston cylinder assembly 57 is secured. Referring to FIGS. 2 and 3, inverted U-shaped frame 61 is affixed to front plate 15 which houses upper pinch roll 43. The piston cylinder assembly 57 positions the pinch roll 43 relative to pinch roll 37, and is mounted on top of the inverted U-shaped frame 61 which guides pinch roll 43 upon its vertical displacement and retains it along a predetermined vertical centerline relative to the lower pinch roll. In looking now particularly to FIG. 3, boom 31 consists of a welded shelf-like structure 63 for mounting two elongated generally horizontally arranged rollers 65 each mounted on either side of the drum 35, and an inverted U-shape welded plate 67 mounted under the shelf 63 for added support to the drum 35 and rollers 65. Spaced from frame 1 to the right of FIG. 3 is a distal plate 69 which supports and interconnects rollers 65 and drum 35 at their outboard ends, shown better in FIG. 2. The two rollers 65 are freely rotatable and are mounted in the plate 69 by a threaded shaft 71 and bearing assembly 73, shaft 33 being mounted in distal plate 69 by an anti-friction bearing assembly 75.

Located below and along the right side of boom 31 as one views FIG. 2 are freely rotatable rollers 81 and 83, respectively. Roller 81 is vertically mounted to the front plate 15 by brackets 85, 87 and roller 83 is horizontally mounted to the front plate by bracket 89 at the right end of roller 83 and bracket 91 at the left end as viewed in FIG. 2, which bracket 91 also carries bearing 87 or roller 81 by a bolt as shown in the broken away section of FIG. 3.

Rollers 65, 81 and 83, whose surfaces are contacted by the convolutions of wire supported on drum 35 aid in the rotation of the coil during the paying off process, and rollers 81 and 83 also aid in preventing the wire from hitting against the front plate 15. Finger 93 shown in FIG. 2 for retaining the coil on the drum during rotation is secured at the end of boom 31 adjacent distal plate 69 and drum 35.

Most of the components of the wire uncoiler mentioned thus far, are generally well known in the art. What is considered to be the essence of the subject invention which was mentioned previously will now be fully described and discussed.

Reference is particularly made to FIGS. 1, 2, 3, 4 and 5 for the various features that relate more specifically to the present invention, and when appropriate, FIGS. 6 and 7 for their operation. In FIG. 4, separator means 27 consists of a plate 95 and a roller 97 which separate the first and each succeeding convolution of the coil individually from the coil on the drum 35. Plate 95 is spaced away in part from frame 1 by being mounted on one end of a horizontal projection 99 in FIG. 2. Behind separator plate 95 adjacent to front plate 15 a pivotal arm 101 also supported by projection 99 supports separator roller 97 which is freely rotatable. As can be seen clearly in FIG. 2, separator roller 97 is located close to the lower pinch roll 37 at a level below the nip between the pinch rolls and arranged so that the convolution being fed to the pinch rolls engage the left outside periphery as viewed in this figure. To accommodate varying diameter coils, the arm and therefore the roller is pivoted accordingly. The pivoting and securing of the roller 97 in a predetermined position to accommodate a coil according to its diameter is accomplished through a bolt and slot arrangement, wherein the bolt 103 is mounted in front plate 15 and slot 105 is provided in arm 101. Lower edge 94 of plate 95 acts as a knife to physically separate one convolution of wire from the other, and as clearly seen in FIG. 4, separator roller 97 aids in facilitating this operation, and also acts as a guide to position the wire between the pinch rolls. As best illustrated in FIG. 2, the shape and extent of separator plate is such that not only does it separate and protect separator roller 97 and upper pinch roll 43 from coil, but it also protects the anvil roll 25. Anvil roll 25 is mounted for free rotation to front plate 15 at approximately the same level as the upper pinch roll 43. It can be stationarily mounted as shown in FIGS. 1, 2, 4 and 6, or it can be constructed to be moved vertically by any conventional adjustment means away from the passline as shown in phantom in FIG. 7.

Mounted to the right of the anvil roll when viewing FIGS. 1 and 2, is pivotal plate means 23 acting as a common carrier having mounted and supported therein around its upper outer surface freely rotatable rolls designated as B, C and D. Particular reference is made to FIG. 5. The plate means includes a rigid plate 107 having a U-shaped cutout for receiving roll C and its bearing assembly. Similarly, rolls B and D are arranged in this plate 107, which is keyed to a shaft 109 supported for rotation by bearing 111 and extending through a bearing 113 to the back on the frame 1, which shaft 109 is connected through a lever 115 and clevis 119 on a rod 121 of a piston cylinder assembly 123 shown in broken lines in FIG. 1. Secured to the outside of the shaft 109 to the right of FIG. 5 is an additional protective plate 125 which as shown in FIG. 2 interfits with separator plate 95. The thin plate 125 protects roll B from the wire on the drum.

Still referring to FIG. 5, rolls "A" and "C" as well as rolls "B" and "D", which are not shown, have two grooves for engaging different diameter wire, one of which is shown supporting the wire W being uncoiled from the coil 36. Above and between rolls C and D in FIGS. 1 and 2, roll A is freely rotatably mounted in rectangular chock 129 slideably contained in an inverted U-shaped frame 131 affixed to front plate 15, similar to the construction of the upper pinch roll 43. Extending into a rectangular chock 129 is a rod 134 shown better in FIG. 5, of a piston cylinder assembly 135 having a cylinder 137 mounted on top of the inverted U-shaped frame. Piston cylinder assembly 135 moves roll A vertically toward and away from the wire passline. In order to provide for automatic positioning of roll A in its operative position for processing succeeding coils of wire of the same diameter and composition, the volume of fluid in the lower end of piston cylinder assembly 135 regulates a slave cylinder 29 whose stroke is controlled by the displacement of a cam 139 opposite a scale 141 (shown in FIG. 1). For example, after cam 139 of the slave cylinder 29 is manually set to a given position on the scale 141, the cam will be moved vertically to trigger a limit switch 143 to limit a proportional downward movement of rod of the cylinder assembly 135 and stop roll "A" at a pre-set position corresponding to the particular diameter and composition of wire being uncoiled.

The relationship of the two piston cylinder assemblies 29 and 135 is such that a large easily pre-selected movement of the slave cylinder 29 results in a much smaller proportional and accurate movement of the piston cylinder assembly 135. This direct dependency is created by a particular selection of the cylinder parameters and providing a direct constant volume flow transfer between the bottom of the cylinder 135 and the bottom of the cylinder 29 indicated by line, L2, with independent flow control of the other ends of the cylinders. The servo system thus provides each piston cylinder assembly 29 and 135 with a portion of its total stroke that is constant and a portion that is variable which can be better appreciated in referring to FIG. 1. The stroke ratio between the piston cylinder 29 and 135 is approximately 3.5:1, in which the controllable stroke portion of the piston cylinder assembly 135 is represented by the length of the scale 141 which is approximately 7" in length which corresponds to an approximate 2" variable controllable distance for the piston cylinder assembly 135, which distance will represent, as noted, the lower extreme of its stroke.

The inverted U-shaped frame 131 provides the support needed to maintain and guide roll "A" in a vertical direction. When roll "A" is positioned away from the passline as shown in hardline in FIG. 5, and in phantom as shown in FIG. 1, it is in its inoperative position. When it is positioned approximately at the same level as the upper pinch roll close to the passline or slightly below, and arranged in a nested cooperative relationship with rolls "C" and "D", which are in their operative position near the passline, as shown in hardline in both FIGS. 1 and 2, roll "A" is in one of its several prepositioned operative positions to cooperate with rolls C and D to engage and straighten the wire. The different operative positions of roll A depends on the diameter and composition of the wire being uncoiled. It is clearly shown in FIGS. 1 and 2 that when rolls C and D are in their operative position, roll B is below the passline in an inoperative position. Furthermore, FIG. 1 illustrates in phantom the leading end of wire partially encircling roll B when in its inoperative position. When plate means 23 is pivoted through a desired arc in a clockwise direction which is achieved by moving rod 121 of piston cylinder assembly 123 to the left as one views FIG. 1, roll B, acting as an end bender roll, is moved upward, thereby positioning the leading end along the passline. In this process the wire is forced against the lower side of the anvil roll 25, and therefore is bent backwards removing most of the curvature originally existing in the leading end when in coil form.

In briefly describing the operation of the invention from the time when the coil is supported on the drum, the pinch roll 43 is raised up, the separator roller 97 is pivotally adjusted to accommodate the diameter of the coil, roll A is positioned in its raised position, and the first convolution of wire is manually brought by an operator behind the separator plate 95 and positioned up over the separator roller 97 between the pinch rolls until the leading end engages and partially encircles roll B. Pinch roll 43 should now be lowered onto the wire.

Figure 6C:
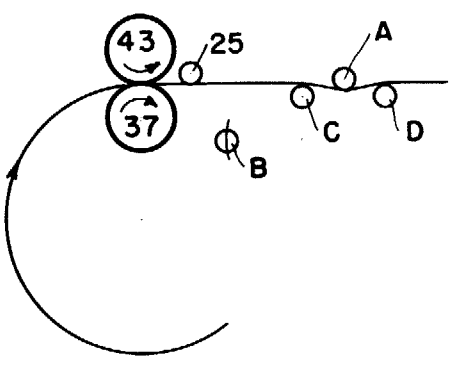
FIGS. 6A-6C are sequential views illustrating three steps of the operation of a first embodiment of the present invention.
Figure 6B:
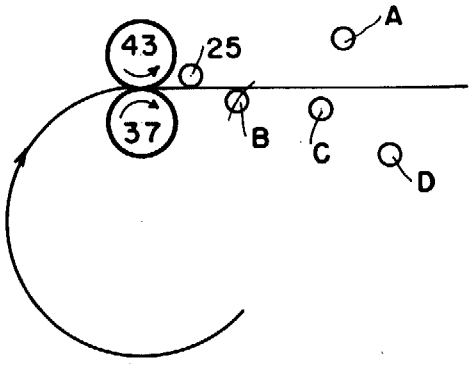
Figure 6A:
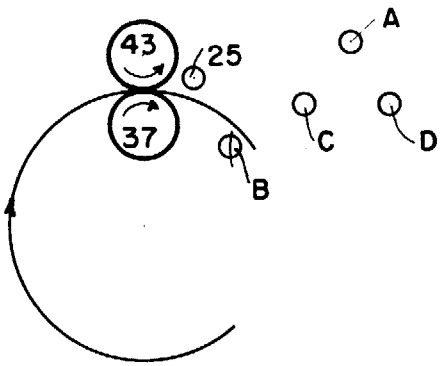

The remaining description of the operation has particular reference to FIGS. 6A through 6C which illustrate a first embodiment of the invention heretofore described as consisting of the end bender roll B, straightening rolls A, C and D, and the anvil roll 25. Plate means 23 is pivoted to raise roll B upward to the passline while rolls C and D are moved downward away from the passline. As mentioned earlier, this involves movement of the rod of piston cylinder assembly 123 to the left of FIG. 1 and the process of roll B moving upward forces the leading end of the wire to engage the anvil roll 25 thereby generally straightening the leading end which now extends slightly beyond the end bender roll B along the passline. After the leading end is driven through the wire straighening area without any interference from rolls A, C and D, since they are away from the passline in their inoperative position as shown in FIG. 6B, the movement of piston cylinder assembly 123 and plate means 23 is reversed, thereby lowering end bender roll B and raising straightener rolls C and D to support the wire along the passline. Prior to this the cam 139 is positioned along the scale 141 to control a proportional amount of movement of piston cylinder assembly 135 to lower roll A toward the passline until a gap more or less corresponding to the diameter of wire presently being payed off is formed when roll "A" assumes a nested or serpentine relationship with rolls C and D per FIG. 6C. The remainder of the wire is then pushed through the straightener rolls by driving the pinch rolls 37, 43 and the drum 35 or the drive mechanism is declutched and the wire is pulled through by some other power means, not shown.

Figure 7B:
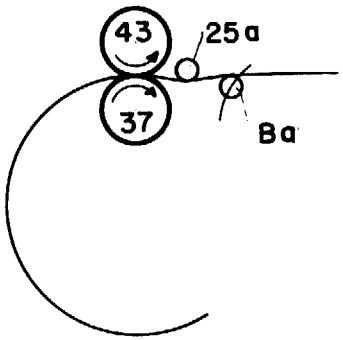
FIGS. 7A and 7B are sequential views illustrating two steps in the operation of a second embodiment of the present invention.
Figure 7A:
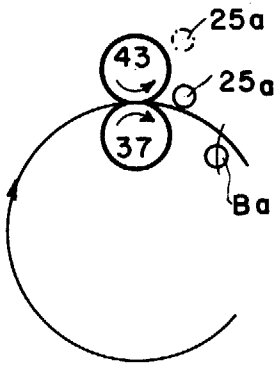

FIGS. 7A and 7B illustrate a second embodiment of the present invention. In this environment a plate means, not shown, similar to plate means 23 carries only roll Ba. These figures illustrate in phantom away from the passline and in hard line near the passline, an anvil roll 25*a* adjustable vertically by suitable means not shown, and in hard line roll Ba which acts first as an end bending roll for the leading end of the coil, and then as a wire straightening roll in cooperation with the anvil roll and pinch rolls.

It is to be noted that the construction of the uncoiler in both embodiments are the same except for the differences described above with reference to FIG. 6A–6C and 7A–7B.

In accordance with the provisions of the patent statutes I have explained the principle and operation of my invention and have illustrated and described what I consider to represent the best embodiment thereof.

I claim:

1. In combination with an apparatus for uncoiling material such as wire from a circular coil and feeding it along a passline for further processing comprising:

means for uncoiling said coil in a manner that the leading end of the wire assumes its natural curvature, bending means located along said passline constructed and arranged for receiving said wire upon its exit from said uncoiling means, said bending means including a first means positionable in an inoperative position away from said passline for engaging a leading end of said wire and positionable in an operative position close to said passline for bending said leading end against its natural curvature to cause it to take a path generally parallel to said passline, and wire straightener means located along said passline constructed and arranged to receive said wire after said wire exits said bending means, said straightener means including first means locatable close to said passline for assuming a straightening position with a longitudinal surface of said wire and second means positionable in a feeding position away from said passline and in an operative position close to said passline for assuming a straightening position with an opposite longitudinal surface of said wire, and means for associating said first means of said bending means with said second means of said straightener means in a manner so that when said first means of said bending means is positioned in its said inoperative position away from said passline said second means of said straightener means is positioned in its said operative position close to said passline, and when said first means of said bending means is positioned in its said operative position close to said passline, said second means of said straightener means is positioned in its said feeding position away from said passline.

2. In an apparatus according to claim 1 wherein said associating means consists of common carrier means for connecting said first means of said bending means to said second means of said straightener means and constructed and arranged to be displaceable relative to said passline to effect said coordinated operation of said bending means and said second means of said straightener means.

3. In an apparatus according to claim 2 including means for supporting said first means of said straightener means along said passline, and pivotal support means for rotatably mounting said carrier means below said passline and constructed and arranged in a manner to be rotated through a predetermined arc to effect said coordinated operation, and means for rotating said carrier means through said arc.

4. In an apparatus according to claim 3 wherein said means for rotating said carrier means consists of a piston cylinder assembly.

5. In an apparatus according to claim 2 wherein said first means of said bending means and said second means of said straightener means includes freely rotatable grooved roll means mounted in said carrier means.

6. In an apparatus according to claim 5 wherein said first means of said bending means and said first means of said straightener means each includes a single roll means, and wherein said second means of said straightener means include two spaced apart roll means, the axis of said two spaced apart roll means and said single roll means of said first means of said straightener means being arranged to form a nested wire straightening relationship when in their said operative position.

7. In an apparatus according to claim 5 wherein said carrier means comprises a rigid plate having openings for receiving said roll means of said bending means and said roll means of said second means of said straightening means for said mounting thereof.

8. In an apparatus according to claim 1 wherein said first means of said straightener means is constructed and arranged in a manner to be adjustable relative to said passline to accommodate varying diameter wires, and means for causing said adjustment of said first means of said straightening means.

9. In an apparatus according to claim 8 wherein said first means of said straightening means comprises a single freely rotatably supported roll and said second means of said straightening means comprises at least two spaced apart freely rotatable supported rolls, the axes of the latter of which are arranged in a common plane and wherein in their operative position they assume a nested relationship with said first means of said straightener means, and wherein said means for adjusting said first means consists of a piston cylinder assembly, and means for stationarily supporting said piston cylinder assembly.

10. In an apparatus according to claim 1 wherein said bending means further comprises second means constructed and arranged to cooperate with said first means of said bending means to effect said bending of said leading end.

11. In an apparatus according to claim 1 wherein said bending means further includes anvil means consisting of a stationarily mounted freely rotatable roll for receiving said wire and constructed and arranged on the side of said passline opposite the side on which said first means of said bending means is arranged to assist the bending of said wire against its natural curvature by said first means of said bending means.

12. In an apparatus for uncoiling material such as wire from a circular coil and preparing the wire for further processing comprising:

a support frame, coil supporting means carried by said support frame and having a rotatable drum over which a coil to be uncoiled is placed, a set of pinch rolls consisting of a lower and upper roll arranged to form a nip for engaging wire being uncoiled from said drum and feeding it along a predetermined passline for said wire, said lower pinch roll mounted coaxially with said drum, means for separating each succeeding loop of wire fed to said pinch rolls from said drum, said separating means having a loop of wire engaging and restraining portion constructed and arranged to support and guide said loop to be fed to said nip, and a protective portion spaced outwardly and separate from said engaging and restraining means, said protective portion constructed and arranged to separate said loop from said coil supported on said drum and to substantially separate and protect at least one of said pinch rolls from said supported coils.

13. In an apparatus for uncoiling wire according to claim 12 wherein said engaging and restraining portion further comprises roller means for engaging an undersurface of said wire of said loop being paid off said drum for guiding and feeding said loop between said pinch rolls.

14. In an apparatus according to claim 13 wherein said roller means further comprises means for adjusting said roller in a predetermined position to accommodate varying diameter loops of different coils.

15. In an apparatus according to claim 14 wherein said adjusting means consists of a bracket pivotally mounted at one end to said support frame and means at said other end of said bracket for freely rotatably supporting said roller, and means for maintaining said roller in said predetermined position.

16. In an apparatus for uncoiling wire according to claim 13 wherein said protective portion includes a knife portion arranged outwardly from said roller means and constructed and arranged to separate a loop of wire supported by said roller means from contact with said coil.

17. A method for uncoiling and preparing material such as wire for further processing from a circular coil supported generally horizontal by a rotatable drum cantileverly mounted to a frame, the steps comprising:

(a) feeding the leading end of the wire between a set of pinch rolls defining a passline until the leading end engages an end bender roll positioned away from the passline, (b) causing the natural curvature of the material to be substantially removed and to take a path generally parallel to the passline by positioning the end bender roll toward the passline so that the wire contacts an anvil roll located on a side of the passline opposite to that of the end bender roll, (c) while step (b) is being performed, simultaneously causing at least two straightener rolls to be moved away from the passline so that the leading end is free to advance along said passline without interference with said straightening rolls while being supported by one of said rolls, (d) when the leading end has passed through the straightener roll area, thereafter causing the two straightener rolls to be positioned toward the passline to support the material in said passline, and the end bender to be positioned away from the passline, and (e) while step (d) is in progress, or thereafter causing a third straightener roll located along the passline generally opposite the other two straightener rolls to be positioned toward the passline so that the straightener rolls contact the material in a nested relationship.

18. A method for uncoiling and preparing material according to claim 17, the steps further comprising:

separating a loop of wire from the coil of material prior to said feeding of material between the pinch rolls, and continuing to separate each succeeding loop of wire from the remaining coil during the uncoiling process.

19. A method for uncoiling and preparing material according to claim 17 the steps further comprising:

causing the remaining material to be pushed or pulled through the straightener rolls.

20. An apparatus for unbending a leading end of material such as wire after it passes between a set of pinch rolls forming a nip and defining a passline for the travel of said wire comprising:

a first means having a wire engaging surface and arranged on one side of said passline of said wire and constructed and arranged to be positionable in a first operative position away from said passline for engaging said leading end and positionable in a second operative position close to said passline to bend said leading end against its natural curvature to take a path generally parallel to said passline, movable support means for mounting said first means and constructed and arranged to allow a leading end of said wire to travel away from said passline where it is engaged by said first means in its said first operative position, second means having a wire engaging surface cooperating with said first means for said unbending of said leading end as said first means is brought into its said second operative position, and power means connected to said support means for positioning said first means in said first and said second operative positions.

21. An apparatus for uncoiling, according to claim 20, wherein said second means is arranged on an opposite side of said passline relative to said first means, and constructed in a manner to be positionable into an operative and an inoperative position relative to said material along its path of travel.

means for positioning said second means in its operative and inoperative positions, and wherein said first and said second means consists of roll means, and said movable support means of said first means comprises a pivotal plate means.

22. In an apparatus for uncoiling material such as wire from a circular coil and preparing the wire for further processing comprising:

a support frame, coil supporting means carried by said support frame and having a rotatable drum over which a coil to be uncoiled is placed, a set of pinch rolls consisting of a lower and upper roll arranged to form a nip for engaging wire being uncoiled from said drum and feeding it along a predetermined passline for said wire, said lower pinch roll mounted coaxially with said drum, means for separating each succeeding loop of wire fed to said pinch rolls from said drum, said separating means having a loop of wire engaging and restraining portion constructed and arranged to guide said loop to said nip, and a protective portion spaced generally coaxially in front of said pinch rolls between said coil and extending over at least a portion of one of said pinch rolls.

* * * * *